United States Patent [19]

Murata et al.

[11] Patent Number: 5,014,633

[45] Date of Patent: May 14, 1991

[54] WORKPIECE FABRIC HOLDING DEVICE FOR USE IN SEWING MACHINE

[75] Inventors: Kunihiko Murata, Tsushima; Satoshi Morii; Toshiaki Iwasaki, both of Nagoya; Hiroyuki Mitsui, Kasugai, all of Japan

[73] Assignee: Brother Kogyo Kabushiki Kaisha, Japan

[21] Appl. No.: 584,166

[22] Filed: Sep. 18, 1990

[30] Foreign Application Priority Data

Oct. 27, 1989 [JP] Japan ..... 1-126183[U]

[51] Int. Cl.[5] ..... D05B 21/00

[52] U.S. Cl. ..... 112/121.12; 112/121.14; 223/38

[58] Field of Search ..... 112/121.12, 121.15, 112/102, 103, 113, 114, 121.14; 223/38

[56] References Cited

U.S. PATENT DOCUMENTS 3,930,454 1/1976 Perlino ..... 112/121.12
4,407,208 10/1983 Meyer ..... 112/121.12
4,493,276 1/1985 Sadeh ..... 112/121.12
4,719,863 1/1988 Bisson ..... 112/121.12
4,883,006 11/1989 Marii et al. ..... 112/121.12

*Primary Examiner*—Peter Nerbun
*Attorney, Agent, or Firm*—Oliff & Berridge

[57] ABSTRACT

A workpiece fabric holding device for holding a pocket cloth onto a garment, and for feeding these on a sewing machine table for effecting a pocket sewing. Various kinds of sewing locus are required for various pocket sewings. A base pressure plate and associated movable pressure plate are provided. The base pressure plate is formed with a major needle slot, and the movable pressure plate is formed with at least two minor needle slots or holes having shapes different from each other. The combination of the major needle slot and one of the minor needle holes will provide a desired needle cut-out having a shape in conformance with a desired sewing locus. A plurality of such combinations can be provided by moving the movable pressure plate relative to the base pressure plate. For this, a holding means is provided to temporarily fix the position of the movable pressure plate.

8 Claims, 7 Drawing Sheets

WORKPIECE FABRIC HOLDING DEVICE FOR USE IN SEWING MACHINE

BACKGROUND OF THE INVENTION

The present invention relates to a workpiece fabric holding device. The present invention also relates to a pocket setter having the workpiece fabric holding device.

An automatic pocket setter unit has been proposed in U.S. Pat. No. 4,883,006 for automatically sewing a pocket to a garment. In this unit, edge portions of a pocket cloth are folded by a pocket folding means, and the folded edge portions are stitched to the garment.

More specifically, as shown in FIG. 6, the pocket setter unit includes a sewing machine 101 for performing stitching operation, a sewing machine table 102, a workpiece fabric holding/feeding unit 103 for pressedly holding a workpiece or a pocket cloth W onto the sewing machine table 102, a pocket folder 104 for folding edge portions of the pocket cloth W and for mounting the pocket cloth onto a garment, and a stacker 105 for successively stacking stitched pocket cloths and the garments. The sewing machine table 102 serves as a working table available for both the pocket folder 104 and the sewing machine 101 as well as for a throat plate therefor.

The sewing machine 101 is provided movable in Y-direction by a moving mechanism which includes a Y-axis servo motor (not shown in FIG. 6) and a toothed belt 112 The workpiece fabric holding/feeding unit 103 includes a pressure plate 114 formed with a slit-like needle cut-out 113, and a feed arm 115 to which the pressure plate 114 is attached. A second moving mechanism is provided for moving the feed arm 115 in X-direction. The second moving mechanism includes a X-axis servo motor 116 and a toothed belt 117. Further, the feed arm 115 is supported on a slider member 118 movable in a vertical direction. The slider member 118 is connected to a pneumatic cylinder 119 whose piston rod is vertically extendible and retractable, so that the feed arm 115 is movable in vertical direction. Consequently, the pressure plate 114 has a descent position in which the plate 114 is pressingly positioned on the sewing machine table 102, and an ascent position in which the plate 114 is moved away from the sewing machine table 102.

The pocket cloth whose edges are folded by the pocket folder 104 is mounted on the garment mounted on the sewing machine table 102. Then, the pocket folder 104 is moved upwardly, and the workpiece holding/feeding unit 103 is moved so as to press the workpieces W (including the pocket cloth and the garment) onto the sewing machine table 102 by the pressure plate 114. Thereafter, the workpiece holding/feeding unit 103 slidingly moves, on the table 102, the workpieces W from a pocket folder position to the sewing machine position. By controlling the movements of the sewing machine 101 and the workpiece fabric holding/feeding unit 103, sewing locus is provided along the needle cut-out 113 formed on the pressure plate 114 for performing a pocket stitching.

In this type of automatic sewing machine, the workpieces W including the pocket cloth and the garment are stackedly pressed on the sewing machine table 102, and the workpieces W are moved by the workpiece fabric holding/feeding unit 103 so as to move the workpieces W along the intended stitching locus. The needle cut-out 113 formed on the pressure plate 114 is of a single line delineating the stitching locus. In accordance with every one of the sewing patterns, every one of the pressure plates 114 is prepared, and the pressure plate 114 is replaced by another pressure plate in accordance with the every change in the sewing patterns and associated sewing programs.

Among various sewing patterns, there are resembling sewing patterns as shown in FIG. 7. In FIG. 7, right and left pocket sewing patterns are shown which are closely resembled with each other, even though not identical to each other. The sewing pattern of the right pocket PA is slightly different from that of the left pocket PB.

Here, according to the conventional device, two kinds of pressure plates 114 each formed with needle cut-out 113 slightly different from each other must be prepared for the right pocket sewing and left pocket sewing. However, it would be troublesome to replace the pressure plate by another pressure plate, even in the case of sewings with respect to the resembling sewing patterns. Particularly, if the right and left pocket sewings must be alternately performed with respect to the identical garment, the sewing efficiency may become greatly lowered due to alternate change of the pressure plate with the another pressure plate.

SUMMARY OF THE INVENTION

The present invention has been made in an attempt to solve the aforementioned drawbacks, and it is an object of the present invention to provide an improved workpiece fabric holding device capable of performing at least two kinds of sewings having sewing loci different from each other regardless of the replacement of a pressure plate.

These and other objects of the present invention will be attained by providing a workpiece fabric holding device for pressing a workpiece fabric on a sewing table and for moving the workpiece relative to the sewing table to a needle position while maintaining the pressing state to the workpiece during sewing operation along a sewing locus, the workpiece holding device comprising a base pressure plate, a movable pressure plate, and a holding means. The base pressure plate is adapted for holding a major part of the workpiece, the base pressure plate being formed with a major needle cut out having a configuration corresponding a major part of the sewing locus for allowing the needle to pass therethrough. The major needle output has open ends and the base pressure plate has a bottom surface. The movable pressure plate is movable relative to the base pressure plate. The movable pressure plate has a bottom surface flush with the bottom surface of the base pressure plate within the opening portion. The movable pressure plate is formed with at least two minor needle cut-outs having configuration corresponding to minor parts of sewing loci contiguous with the major sewing locus. The holding means is adapted for selectively holding the movable pressure plate at predetermined positions where at least one of the minor needle cut-outs is aligned with the major needle cut-out.

In another aspect of the present invention there is provided a pocket setter for sewing a pocket cloth to a garment, the pocket setter including a sewing machine, a sewing table, a feed arm, actuation means for moving the feed arm and for moving the sewing machine, and a sewing machine motor for driving the sewing machine and the improvement comprising; a base pressure plate for holding a major part of the pocket cloth, the base pressure plate being formed with a major needle cut out having a configuration corresponding to a major part of a sewing locus for allowing the needle to pass therethrough, the base pressure plate being also formed with an opening portion at which the major needle cut out is opened, the base pressure plate having a bottom surface; a movable pressure plate movable relative to the base pressure plate, the movable pressure plate having a bottom surface being flush with the bottom surface of the base pressure plate within the opening portion, the movable pressure plate being formed with at least two minor needle cut-outs having configuration corresponding to minor parts of sewing loci contiguous with the major sewing locus, and a holding means for selectively holding the movable pressure plate at predetermined positions where at least one of the minor needle cut-outs is aligned with the major needle cut-out, the base pressure plate being connected to the feed arm.

By shifting a position of the movable pressure plate into one position, at least one of the minor needle cut-outs becomes contiguous with the major needle cut out, and by changing or shifting a position of the movable pressure plate into another position, at least remaining one of the minor needle cut-outs becomes contiguous with the major needle cut out. Accordingly, different kinds of resultant needle cut-outs are promptly provided in accordance with a change in sewing locus.

DETAILED DESCRIPTION OF THE PREFERRED EMBODIMENT

A workpiece fabric holding device according to one embodiment of this invention will be described with reference to FIGS. 1 through 5. Descriptions given hereinbelow concerns the workpiece fabric holding device which is applied to a pocket setter for holding a pocket cloth onto a garment and for stitching the pocket cloth thereto in accordance with a given stitching locus.

Figure 1:
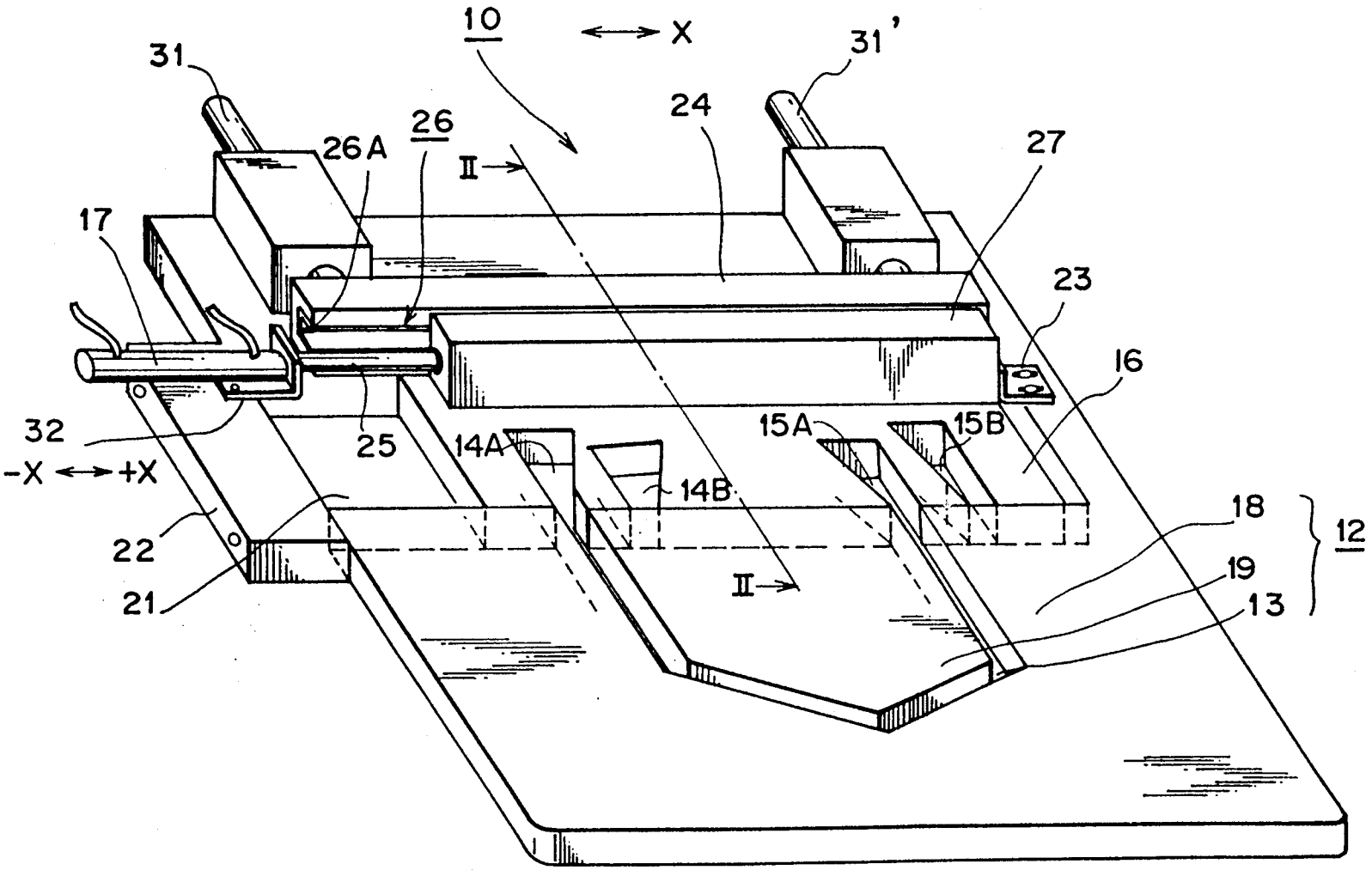
FIG. 1 is a perspective view showing a workpiece fabric holding device according to one embodiment of this invention.
Figure 6:
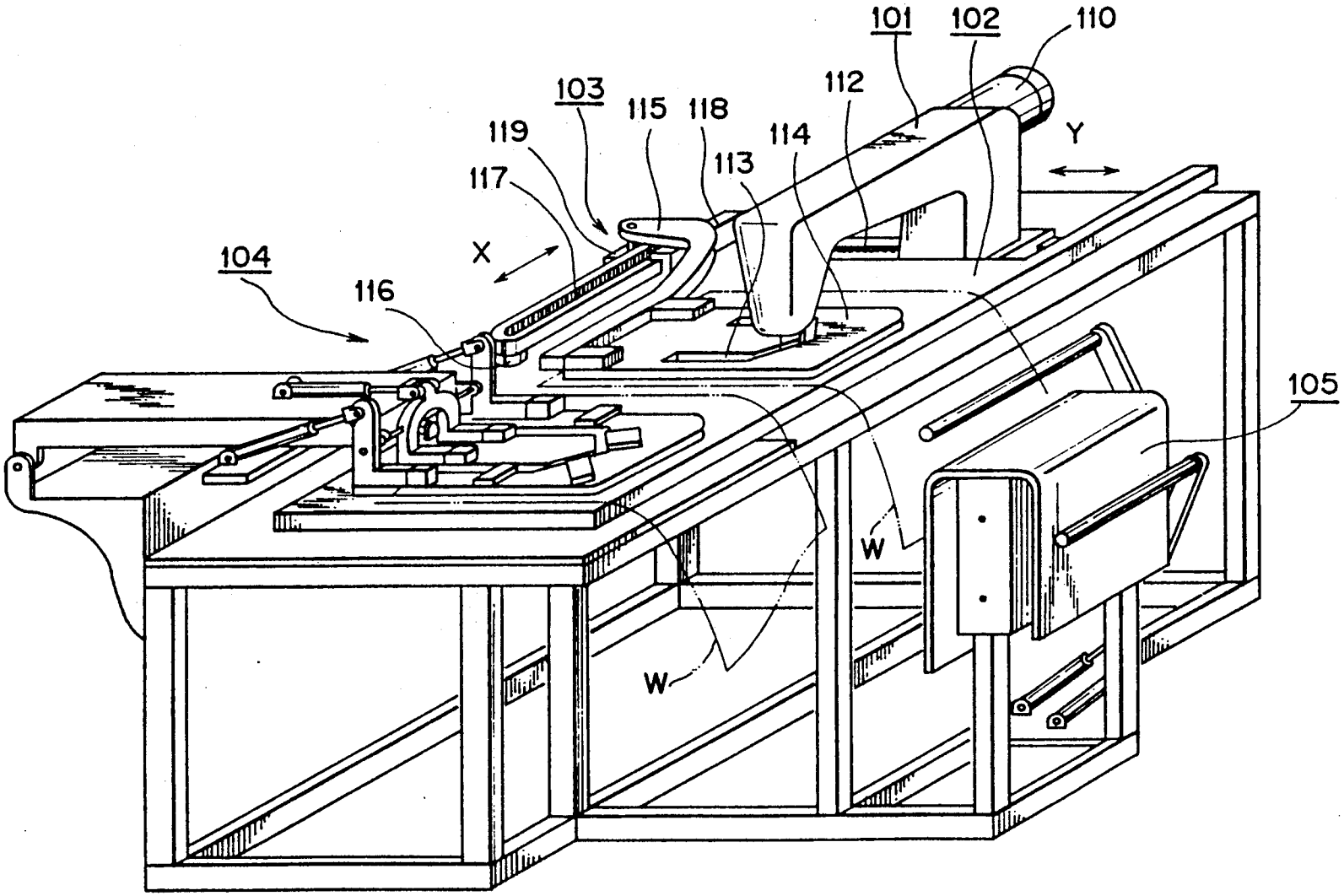
FIG. 6 is a perspective view showing a conventional pocket setter.

The workpiece fabric holding device 10 shown in FIG. 1 corresponds to a pressure plate 114 of a conventional pocket setter unit shown in FIG. 6. This holding device 10 of this invention is attached to a feed arm 115 shown in FIG. 6 instead of the attachment of the pressure plate 114. Therefore, the holding device 10 is horizontally movable in X direction as well as vertically movable in accordance with the movement of the feed arm 115.

Figure 7:
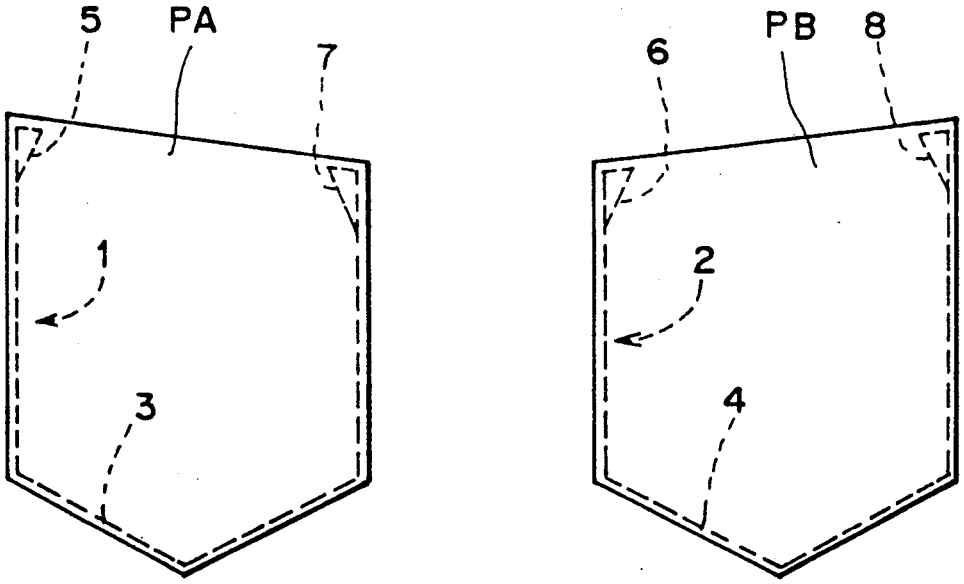
FIG. 7 is a view for description of right and left pocket configurations.

The workpiece fabric holding device 10 is adapted to perform right and left pocket sewings shown in FIG. 7. Stitching loci 1 and 2 are symmetrical with each other, and include identical stitching loci portions 3 and 4, and different stitching loci portions 5, 7 and 6, 8. The right and left pocket sewings are alternately performed with respect to each one of the garments.

Turning back to FIG. 1, the workpiece fabric holding device 10 is provided with a base pressure plate 12, a movable pressure plate 16 and a pneumatic cylinder 17. The base pressure plate 12 is adapted for pressing the major part of the workpiece onto a sewing machine table 102 (see FIG. 6), which major part includes the stitching portions 3 and 4 (see FIG. 7). The base pressure plate 12 is formed with a needle cut out 13 whose configuration corresponds to the identical stitching loci portions 3 and 4 of the stitching loci 1 and 2. The movable pressure plate 16 is adapted for pressing a remaining part (upper sections of the pocket portions) of the workpiece onto the sewing machine table 102 which remaining part includes the different stitching portions 5, 6, 7 and 8. For this, the movable pressure plate 16 is formed with needle cut-outs 14A, 14B, 15A and 15B those corresponding to the different stitching portions 5, 6, 7 and 8, respectively. The pneumatic cylinder 17 is connected to the movable pressure plate 16 for moving the movable pressure plate 16 in X-direction, and for positioning the latter at a predetermined position.

Figure 3:
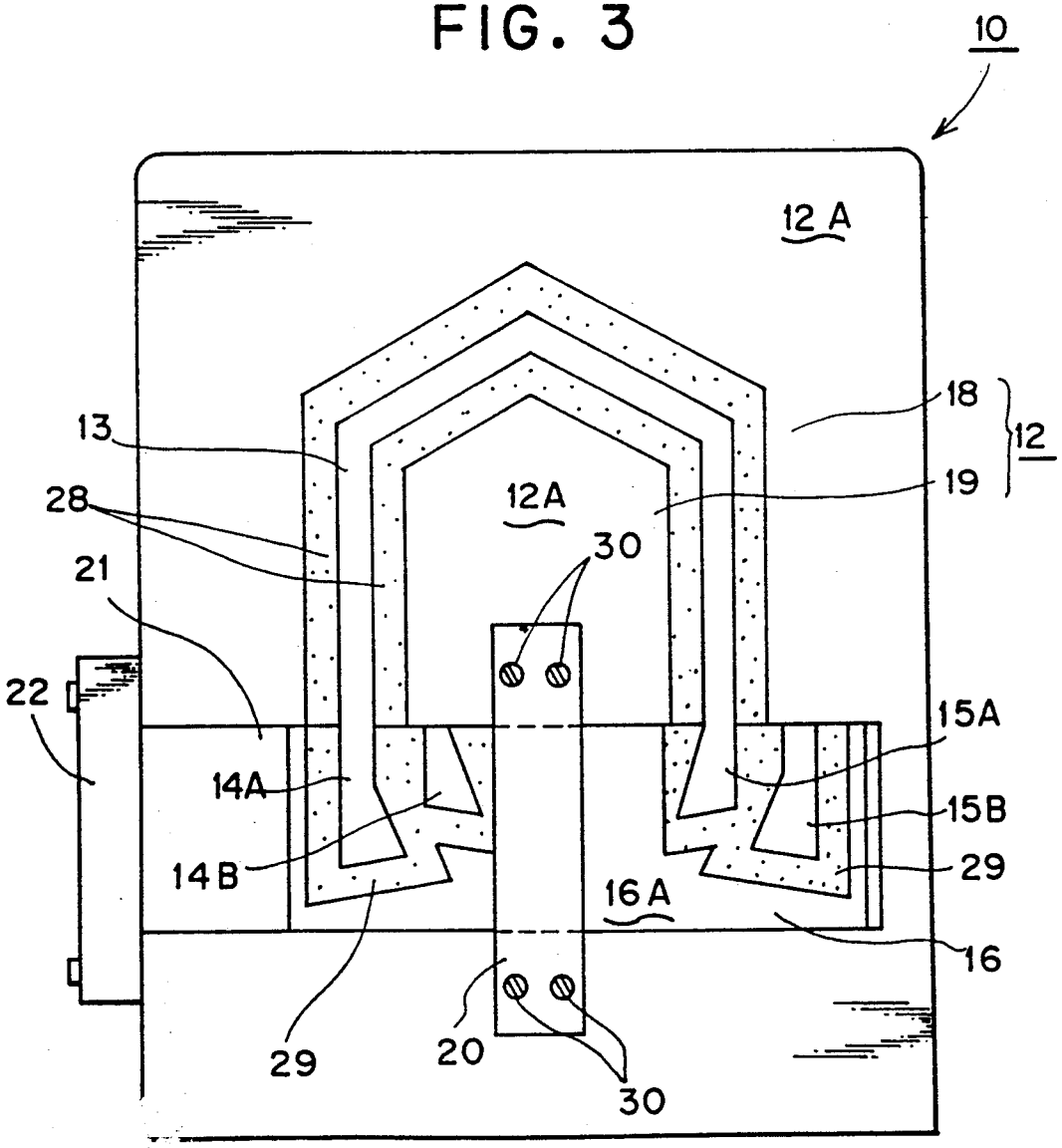
FIG. 3 is a bottom view showing the workpiece fabric folding device.

As best shown in FIG. 3, the base pressure plate 12 includes an outer member 18 which forms an outer contour of the needle cut out 13, an inner member 19 which forms an inner contour of the needle cut out 13, and a connection plate 20 connecting together the outer and inner member 18 and 19 by means of countersunk screws 30. One end portion of the outer member 18 is fixed with jigs 31, 31' for detachably connecting the outer member 18 to a feed arm 115 shown in FIG. 6.

The base pressure plate 12 is also formed with an opening portion 21 whose one end portion is open to the pneumatic cylinder 17. Further, a reinforcing plate 22 is detachably connected to the open end portion of the opening portion 21, and the pneumatic cylinder 17 is fixedly installed on an upper surface of the reinforcing plate 22 through a bracket 32. At another end portion opposite the open end portion of the opening portion 21, a stop member 23 is provided. The stop member 23 has an upstanding portion and a base portion, and the upstanding portion is positioned more closer to the pneumatic cylinder 17 than the base portion. The base portion is fixed to the base pressure plate 12, but the fixed position is controllable in the X direction, so that the upstanding portion can be moved toward and away from the pneumatic cylinder 17 within the controlled range.

Figure 2:
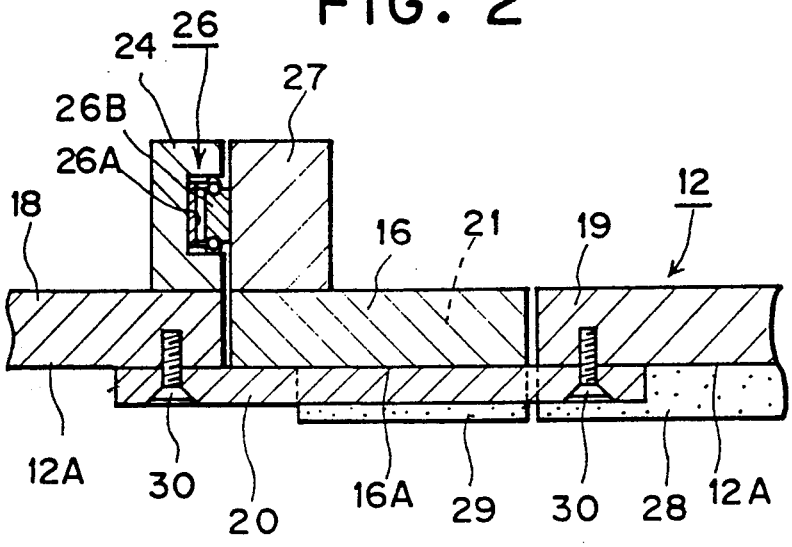
FIG. 2 is a cross-sectional view taken along the line II—II of FIG. 1 showing the workpiece fabric holding device.

A linear guide 24 is fixed to the base pressure plate 12 by screws, and further, there is provided a ball slider 26 including a stationary segment 26A and a movable segment 26B. The stationary segment 26A of the ball slider 26 is fixed to the linear guide 24 by screws, whereas the movable segment 26B is fixed to a block 27 by screws as best shown in FIG. 2. The block 27 is connected to a piston rod 25 of the pneumatic cylinder 17. The block 27 is positioned abut table on the stop member 23 when the piston rod 25 is extended.

The movable pressure plate 16 is fixedly connected to the block 27 by screws. In this connection, the movable pressure plate 16 is provided movable in X direction with respect to the base pressure plate 12 by means of the ball slider 26 and the linear guide 24. That is, upon actuation of the pneumatic cylinder 17, the piston rid 25 is extended, so that the block 27 and the movable segment 26B are moved with undergoing linear guidance by the linear guide 24, to thereby move the movable pressure plate 16. As best shown in FIG. 2, the movable pressure plate 16 has a bottom surface 16A within the opening portion 21 of the base pressure plate 12. The bottom surface 16A of the movable pressure plate 16 is flush with a bottom surface 12A of the base pressure plate 12 within the opening portion 21. The pneumatic cylinder 17, the block 27 and the stop member 23 constitute, in combination, a workpiece holding means.

As described above, the movable pressure plate 16 is formed with four diagonal or trapezoid needle holes or cutouts 14A, 14B, 15A and 15B for sewing the diagonal or trapezoid sewing pattern portions 5, 6, 7 and 8 shown in FIG. 7. More specifically, the first trapezoid needle hole 14A positioned the closest to the reinforcing plate 22 is provided for the purpose of sewing the upper right side trapezoid portion 5 of the right pocket PA, the second trapezoid needle hole 14B positioned the second closest to the reinforcing plate 22 is provided for the purpose of sewing the upper right side trapezoid portion 6 of the left pocket PB, the third trapezoid needle hole 15A is provided for sewing the upper left side trapezoid portion 7 of the right pocket PA, and the fourth trapezoid needle hole 15B is provided for sewing the upper left side trapezoid portion 8 of the left pocket PB.

As shown in FIGS. 2 and 3, sponge like elastic members 28 and 29 are attached on the lower surface 12A of the base pressure plate 12 and the lower surface 16A of the movable pressure plate 16 at positions surrounding the needle cut out 13 and trapezoid needle cut outs 14A thru 15B, respectively. These sponge like elastic members 28 and 29 have thicknesses identical with each other and larger than the thickness of the connection plate 20 for suitably pressing the workpiece W (see FIG. 6) onto the sewing machine table 102.

With such arrangement, the movable pressure plate 16 is moved in X-direction by way of the block 27 in response to extension and retraction of the piston rod 25 of the pneumatic cylinder 17. If the piston rod 25 is extended, the movable pressure plate 16 is moved in +X direction, so that one end of the block 27 is brought into abutment with the stop member 23. Upon abutment, the block 27 and the movable pressure plate 16 are stopped at the abutting position , and the stop position is maintainable because of the urging force by the pneumatic cylinder 17. In this case, two open ends of the generally U-shaped major needle cut out 13 are aligned with the first and third trapezoidal needle holes 14A and 15A, and therefore, resultant needle cut out has a configuration corresponding to the sewing locus 1 for the right pocket sewing PA shown in FIG. 7.

On the other hand, if the piston rod 25 is retracted, the movable pressure plate 16 is moved in -X direction, so that the movable pressure plate 16 is stopped at the ultimate stroke end position of the pneumatic cylinder 17. This stop position is maintainable by the urging force of the pneumatic cylinder 17. In this case, the open ends of the generally U-shaped major needle cutout 13 are aligned with the second and fourth trapezoidal needle cut-outs 14B and 15B, and therefore, resultant needle cut out has a configuration corresponding to the sewing locus 2 for the left pocket sewing PB shown in FIG. 7.

The workpiece fabric holding device 10 thus constructed is assembled to the feed arm 115 shown in FIG. 6 through the jigs 31, 31'. The feed arm 115 will move the workpiece fabric holding device 10 to its ascent position so as to allow the workpiece W to be inserted into a space defined between the holding device 10 and the sewing machine table 102. The feed arm 115 will also move the workpiece fabric holding device 10 to its descent position so as to pressingly hold the workpiece W onto the sewing machine table 102, The feed arm will also move the holding device 10 in a horizontal direction so as to horizontally and slidingly move the workpiece W relative to the sewing machine table 102.

Next, will be described with reference to FIG. 4 a control device for controlling the pneumatic cylinder 17 shown in FIG. 1 and for controlling an X-axis motor 116, a pneumatic cylinder 119, a sewing machine 101, and a pocket folder 104, those shown in FIG. 6. As described in the Background of the Invention section, the feed arm 115 is movable in X-direction by the X-axis servo motor 116. Further, the sewing machine 101 is movable in Y-direction by a Y-axis servo motor 111 (not shown in FIG. 6, but shown in FIG. 4). Further, the actual sewing operation is made by a sewing machine motor 111 shown in FIG. 4. Furthermore, as described in the Background section, the pneumatic cylinder 119 is provided for providing vertical motion of the feed arm 115.

Figure 4:
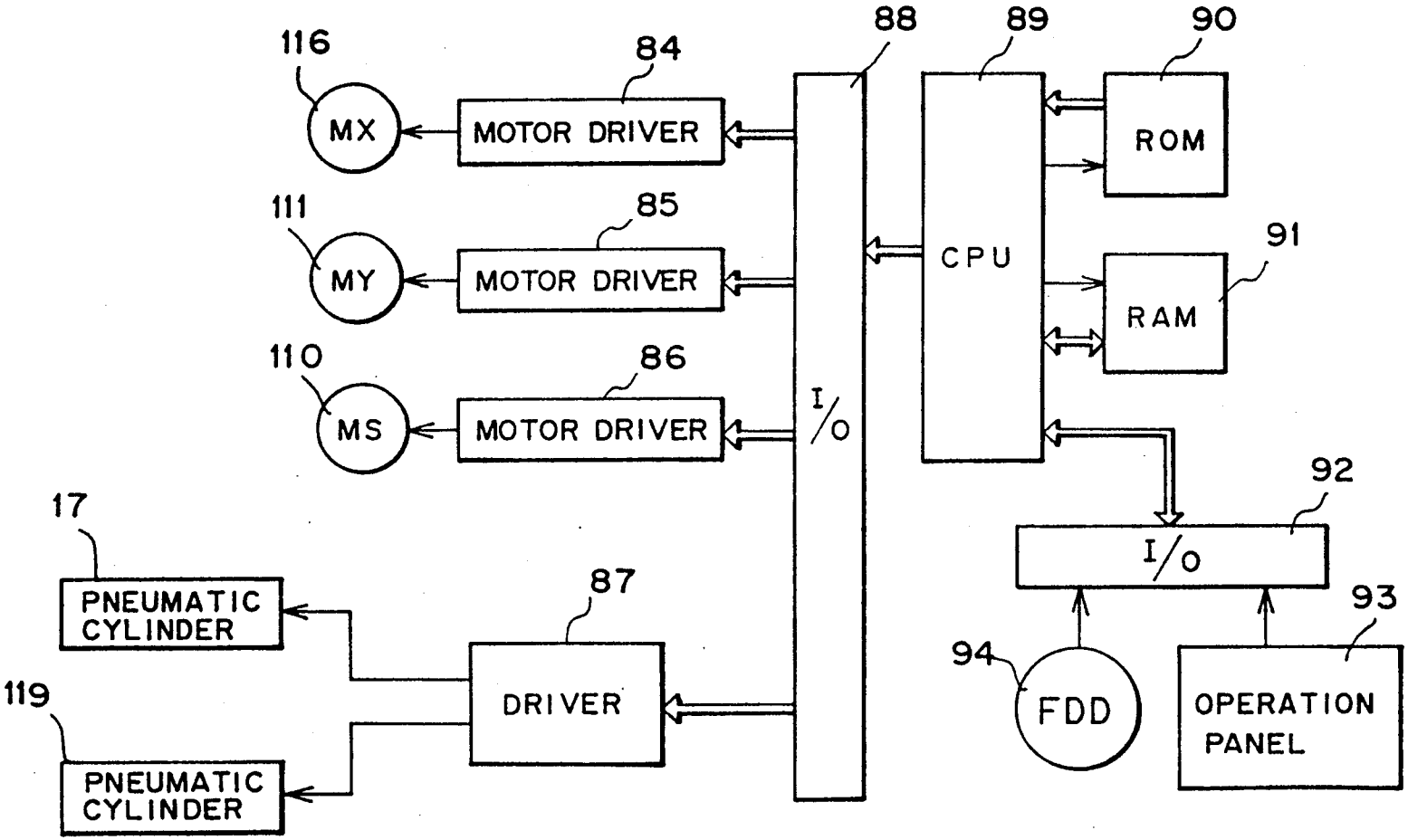
FIG. 4 is a block diagram showing a pocket setter controlling device according to one embodiment of this invention.

As shown in FIG. 4, connected to a central processing circuit (CPU) 89, through an output interface 88, are a motor driver 84 for driving the X-axis servo motor 116, a second motor driver 85 for driving the Y-axis motor 111, a third motor driver 86 for driving the sewing machine motor 110, and a fourth driver 87 for driving the pneumatic cylinders 17 and 119. This CPU 89 is connected to a read only memory ROM 90 in which various sewing programs are stored, and to a random access memory RAM 91. Further, the CPU 89 is connected to a floppy disc drive FDD 94 and an operation panel 93 through an input/output interface 92. In a floppy disc (not shown), various sewing program data for making various sewing patterns or locus are stored, and the sewing program data stored in the floppy disc is fetched by the FDD 94, and is stored in the RAM 91. Further, the operation panel 93 has a start switch and a plurality of switches for performing intended sewing.

According to this embodiment, the floppy disc stores therein a sewing program data for a sewing pattern A in order to realize the sewing along the sewing locus 1, and another sewing program data for sewing pattern B in order to realize the sewing along the sewing locus 2. Further, the switches of the operation panel 93 are adapted for selection of sewing orders, i.e., whether or not the sewing pattern A or B are continuously carried out, or whether or not the sewing patterns A and B are alternately carried out. Furthermore, remaining one of the switches on the operation panel 93 is adapted for selection of start of the sewing pattern, i.e., whether or not the sewing pattern A is firstly carried out. Another remaining one of the switches serves to input the re-sewing and re-arramgement of the sewing orders. The operation panel 93 also has a section for inputting the numbers of the workpieces to be sewn.

Figure 5A:
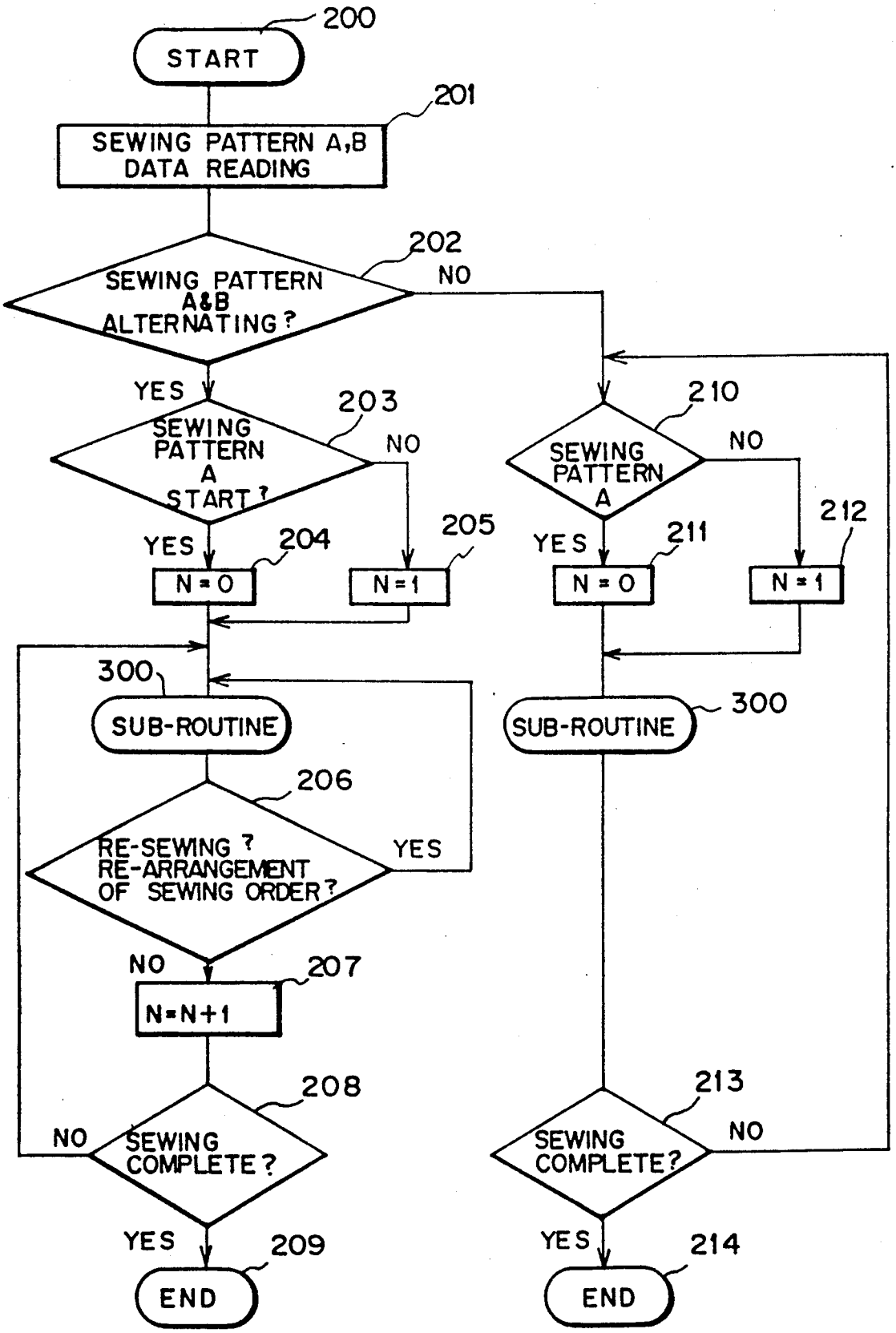
FIGS. 5(*a*) and 5(*b*) are flow charts for description of operational sequence in the controlling device.
Figure 5B:
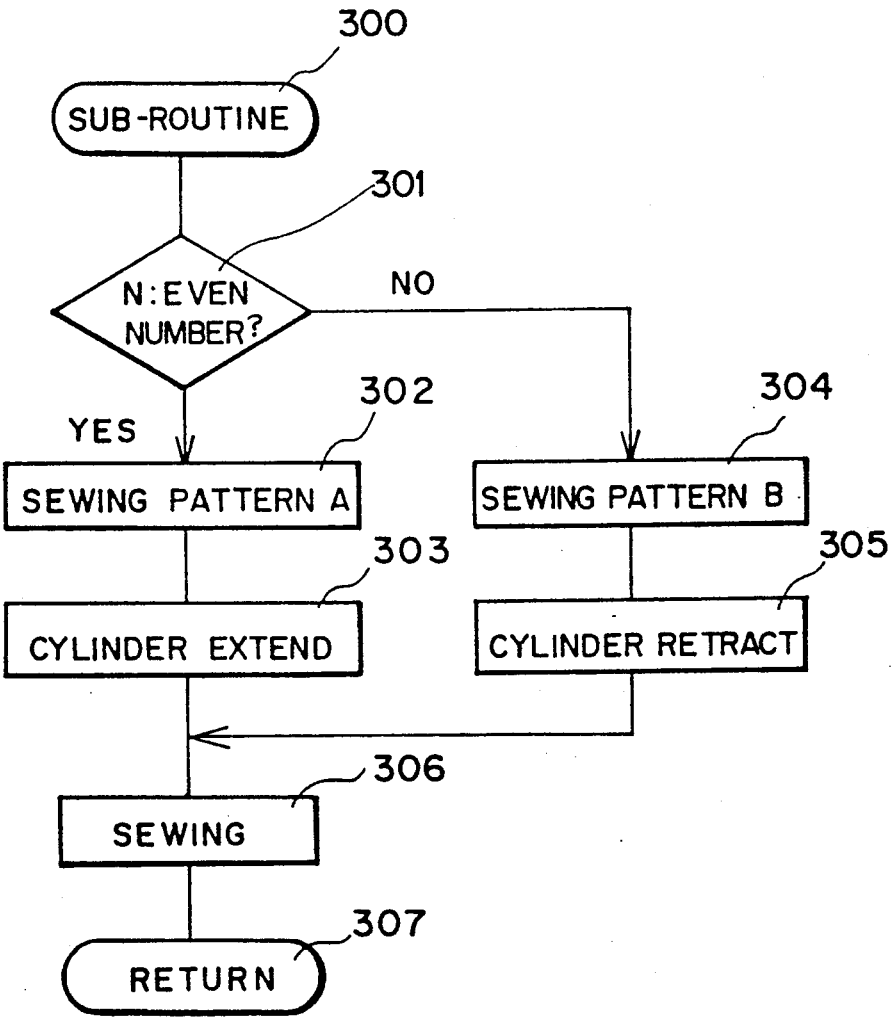

In FIGS. 5(*a*) and 5(*b*), upon instruction from the CPU 89, the piston rod 25 of the pneumatic cylinder 17 is moved in its axial direction so as to switch the position of the movable pressure plate 16, and simultaneously, the sewing program is also changed.

More specifically, as shown in FIGS. 5(*a*) and 5(*b*) in which a processing routine of the CPU 86 is delineated, when the start switch on the operation panel 93 is depressed, the CPU 89 enters into the processing routine at step 200. Then, the routine proceeds into step 201 where the sewing program data for executing the sewing patterns A and B are transmitted through FDD 94 into the RAM 91. Next, in step 202, judgment is made as to whether or not the switch of the operation panel 93 is set on alternating sewing patterns between patterns A and B. If YES, the routine proceeds into step 203 in which checked is the switching state of the switch of the operation panel 93, as to whether or not the sewing pattern A is to be firstly started. If YES, the routine proceeds into step 204 where a count N=0 is set. On the other hand, if NO, the routine proceeds into step 205 where a count N=1 is set. Then a sub-routine processing will be executed in step 300 as shown in FIG. 5(*b*).

In the sub-routine 300, decision is made as to whether or not N is the even number in step 301. If YES, the routine proceeds into step 302 where the sewing program data for performing the sewing pattern A stored in the RAM 91 is selected. Then, in a subsequent step 303, CPU 89 transmits output signal to the fourth driver 87, so that the piston rod 25 of the pneumatic cylinder 17 is extended. Then, the pneumatic cylinder 17 moves the movable pressure plate 16 in X direction through the block 27, and the block 27 is coming into abutment with the stop member 23, so that the shifted position of the movable pressure plate 16 and the block 27 are maintained by the urging force of the cylinder 17. In this instance, the main needle cut out 13 is aligned with the first and third trapezoidal needle cut outs 14A and 15A, so that the resultant needle cut out conforms the right pocket sewing locus 1.

On the other hand, in step 301, if the decision falls NO, i.e., if the N is the odd number, the routine proceeds into step 304 where the sewing program data for performing the sewing pattern B stored in the RAM 91 is selected. Then, in a subsequent step 305, the CPU 89 transmits output signal to the fourth driver 87, so that the piston rod 25 of the pneumatic cylinder 17 is retracted. Then, the pneumatic cylinder 17 moves the movable pressure plate 16 in −X direction through the block 27, and the block 27 and the movable pressure plate 16 are positioned at the ultimate stroke end position of the cylinder 17 and the position is maintained by the urging force of the cylinder 17. In this instance, the major needle cut out 13 is aligned with the second and fourth trapezoidal cut outs 14B and 15B,, so that the resultant needle cut out conforms the left pocket sewing locus 2.

Next, the routine proceeds into step 306 for performing actual pocket sewing to the garment. In the sewing, CPU 89 sends output signals to the first to third motor drivers 84, 85 and 86 for driving the X-axis servo motor 116, the Y-axis motor 111 and the sewing machine motor 110 in accordance with the sewing program data fetched at the step 302 or 304. As a result, the workpiece W is relatively moved to the actual needle descent position, and intended sewing is performed.

When the sewing is finished, the routine proceeds into step 206 where a state of the switch on the panel 93 is checked. Through the checking, checked are the switch positions indicative of re-sewing or re-arrangement of the sewing pattern order. If the checking falls YES, the subroutine 300 is again executed. On the other hand, if the checking falls NO, the routine proceeds into step 207, where N=N+1 is set. In the subsequent step 208, checked is the finishing of the predetermined numbers of sewings with respect to predetermined numbers of workpieces W. If YES, the routine is stopped. On the other hand, if the checking falls NO, the sub-routine processing is again executed.

In step 208, if the decision falls NO, i.e., sewings according to the sewing patterns A and B should not be alternately performed, but only one of the sewing according to only one of the sewing patterns A and B should be repeatedly carried out, the routine proceeds into step 210 where a state of the switch is checked, and decision is made as to whether or not the switch is on the position indicative of the sewing of the sewing pattern A. If decision falls YES, the routine proceeds into step 211 where N=0 is set. If the decision falls NO, the routine proceeds into step 212 where N=1 is set. Thereafter, the above described sub-routine 300 is executed. If the sewing under the sub-routine 300 is finished, in step 213, the state of the operation switch is checked. If the predetermined numbers of the sewing operations has been completed, the processing is terminated in step 213, and if there are unsewn workpieces, the checking falls NO, so that the routine returns to step 210.

As described above, in the workpiece fabric holding device according to one embodiment of this invention, selection of the sewing pattern orders and change in the sewing locus can be made by the signal from the CPU 89. Therefore, sewing efficiency is greatly improved in a case where the right and left pockets are alternately sewn to the garment.

In the above described embodiment, the movable pressure plate 16 is moved by the pneumatic cylinder 17, and the CPU 89 controls the pneumatic cylinder 17 so as to automatically change the position of the movable pressure plate 16, and at the- same time, the CPU changes the sewing programs in association with the positions of the movable pressure plate 16. However, it would be also possible to manually change or shift the position of the movable pressure plate 16. In this case, a rack mechanism or a positioning pin may be required for maintaining the movable pressure plate 16 at the shifted position. Further, a position sensor such as a limit switch may be required so as to detect the shifted position of the movable pressure plate 16. A signal from the position sensor may be transmitted to the CPU 89 so as to change the sewing program or so as to set the CPU 89 in interlocking state.

As described above, in the present invention, at least two kinds of sewing locus are selectively provided by the movement of the movable pressure plate. Different kinds of sewing locus can be promptly provided without changing the workpiece fabric holding device in its entirety. In this connection, if right and left pocket sewings are performed in which sewing loci of the two are slightly different from each other, and if the right and left pocket sewings are alternately carried out or if predetermined numbers of the left pocket sewings are performed after predetermined numbers of the right pocket sewings are carried out, the sewing patterns can be easily changed, to thereby greatly enhance sewing efficiency.

While the invention has been described in detail and with reference to specific embodiment thereof, it would be apparent to those skilled in the art that various changes and modifications can be made therein without departing from the spirit and scope of the invention.

What is claimed is:

1. A workpiece fabric holding device for pressing a workpiece fabric on a sewing table and for moving the workpiece relative to the sewing table to a needle position while maintaining the pressing state to the workpiece during sewing operation along a sewing locus, the workpiece holding device comprising;

a base pressure plate (12) for holding a major part of the workpiece, the base pressure plate being formed with a major needle cut out (13) having a configuration corresponding to a major part of the sewing locus (3, 4) for allowing a needle to pass therethrough, the major needle cutout (13) having open ends, and the base pressure plate having a bottom surface (12A);

a movable pressure plate (16) movable relative to the base pressure plate (12), the movable pressure plate (16) having a bottom surface (16A) being flush with the bottom surface (12A) of the base pressure plate (12), the movable pressure plate (16) being formed with at least two minor needle cut-outs (14A, 14B, 15A, 15B) having configurations corresponding to minor parts of sewing loci (5, 6, 7, 8) contiguous with the major sewing locus (3, 4); and a holding means (17,27,23) for selectively holding the movable pressure plate (16) at predetermined positions where at least one of the minor needle cut-outs (14A, 14B, 15A, 15B) is aligned with the major needle cut-out (13).

2. The workpiece fabric holding device as claimed in claim 1, wherein the base pressure plate is formed with an opening portion (21) at which the open ends of the major needle cutout (13) is opened, the movable pressure plate (16) being movably positioned within the opening portion (21).

3. The workpiece fabric holding device as claimed in claim 1, wherein the holding means (17, 27, 23) comprises;

a pneumatic cylinder (17) mounted on the base pressure plate (12) and having a piston rod (25);

a block (27) connected to the piston rod (25) and fixedly connected to the movable pressure plate (16); and a stop member (23) positioned on the base pressure plate (12) for restricting movement of the block (27), whereby the movable pressure plate (16) has a first position when the block (27) abuts the stop member (23) and has a second position when the piston rod (25) is retracted to its stroke end position.

4. The workpiece fabric holding device as claimed in claim 3, further comprising;

a guide (24) fixedly mounted on the base pressure plate (12) and linearly extending in a direction of moving the movable pressure plate (16); and a slider member (26) having a movable segment (26B) fixed to the block (27) and a stationary segment (26A) fixed to the guide (24), the movable segment (26B) being guided by the stationary segment (26A) for guiding linear movement of the block (27).

5. A pocket setter for sewing a pocket cloth to a garment, the pocket setter including a sewing machine (101), a sewing table (102), a feed arm (115), actuation means for moving the feed arm (115) and for moving the sewing machine (101), and a sewing machine motor for driving the sewing machine and the improvement comprising;

a base pressure plate (12) for holding a major part of the pocket cloth, the base pressure plate being formed with a major needle cut out (13) having a configuration corresponding to a major part of a sewing locus (3, 4) for allowing a needle to pass therethrough, the base pressure plate being also formed with an opening portion (21) at which the major needle cut out (13) is opened, the base pressure plate having a bottom surface (12A), the base pressure plate (12) being connected to the feed arm (115);

a movable pressure plate (16) movable relative to the base pressure plate (12), the movable pressure plate (16) having a bottom surface (16A) being flush with the bottom surface (12A) of the base pressure plate (12) within the opening portion (21), the movable pressure plate (16) being formed with at least two minor needle cut-outs (14A, 14B, 15A, 15B) having configurations corresponding to minor parts of sewing loci (5, 6, 7, 8) contiguous with the major sewing locus (3, 4); and a holding means (17,27,23) for selectively holding the movable pressure plate (16) at predetermined positions where at least one of the minor needle cut-outs (14A, 14B, 15A, 15B) is aligned with the major needle cut-out (13).

6. The pocket setter as claimed in claim 5, wherein the holding means (17, 27, 23) comprises;

a first pneumatic cylinder (17) mounted on the base pressure plate (12) and having a piston rod (25);

a block (27) connected to the piston rod (25) and fixedly connected to the movable pressure plate (16); and a stop member (23) positioned on the base pressure plate (12) for restricting movement of the block (27), whereby the movable pressure plate (16) has a first position when the block (27) abuts the stop member (23) and has a second position when the piston rod (25) is retracted to its stroke end position.

7. The pocket setter as claimed in claim 6, further comprising;

a guide (24) fixedly mounted on the base pressure plate (12) and linearly extending in a direction of moving the movable pressure plate (16); and a slider member (26) having a movable segment (26B) fixed to the block (27) and a stationary segment (26A) fixed to the guide (24), the movable segment (26B) being guided by the stationary segment (26A) for guiding linear movement of the block (27).

8. The pocket setter as claimed in claim 7, wherein the actuation means comprises an X-axis motor (116) for moving the feed arm (115) in an X-direction, a second pneumatic cylinder (119) for moving the feed arm (115) in a vertical direction, and a Y-axis motor for moving the sewing machine (101) in a Y-direction, and the pocket setter further comprising a control, device for controlling the second pneumatic cylinder (119), the first pneumatic cylinder (17), the X-axis motor (116), and the sewing machine (101), the control device storing therein a plurality of sewing program data corresponding to each one of the sewing loci, and operating these cylinders, motor and the sewing machine in accordance with a selected one of sewing programs for performing a sewing according to the selected one of the sewing loci.

* * * * *